United States Patent [19]

Gill et al.

[11] 4,245,588

[45] Jan. 20, 1981

[54] VAPOR GENERATING SYSTEM HAVING A DIVISION WALL PENETRATING A FURNACE BOUNDARY WALL FORMED IN PART BY ANGULARLY EXTENDING FLUID FLOW TUBES

[75] Inventors: William J. Gill, New York, N.Y.; Nick Albanese, Parsippany, N.J.; Michael B. Herbacsek, West Orange, N.J.; Harvey H. Nelken, River Edge, N.J.

[73] Assignee: Foster Wheeler Energy Corporation, Livingston, N.J.

[21] Appl. No.: 3,839

[22] Filed: Jan. 16, 1979

[51] Int. Cl.[3] ..... F22B 37/20

[52] U.S. Cl. ..... 122/6 A; 122/235 A; 122/235 K; 122/478; 122/406 S

[58] Field of Search ..... 122/6 A, 235 A, 235 K, 122/478, 406 S

[56] References Cited

U.S. PATENT DOCUMENTS

| | | | |
|---|---|---|---|
| 1,667,833 | 5/1928 | Bell | 122/6 A |
| 1,762,246 | 6/1930 | Shannon | 122/6 A |
| 1,796,284 | 3/1931 | Davy | 122/235 A |
| 2,267,027 | 12/1941 | Handgrove | 122/6 A |
| 2,293,735 | 8/1942 | Handgrove | 122/6 A |
| 2,304,788 | 12/1942 | Bailey | 122/6 A |
| 2,798,464 | 7/1957 | Seidl | 122/478 |
| 2,803,227 | 8/1957 | Marshall | 122/478 |
| 4,116,168 | 9/1978 | Gorzegno et al. | 122/510 |

*Primary Examiner*—Henry C. Yuen

*Attorney, Agent, or Firm*—Marvin A. Naigur; John E. Wilson; John J. Herguth, Jr.

[57] ABSTRACT

A vapor generator including an upright furnace section the boundary walls of which are formed by a plurality of tubes, a portion of which extend at an angle with respect to a horizontal plane. A plurality of divisional walls are provided which extend from an area externally of the boundary walls and which penetrate a boundary wall and terminate within the furnace section. The latter boundary wall is provided with a seal assembly extending over the area of penetration of the boundary wall. Fluid is passed sequentially through the tubes forming the boundary walls and the division walls to heat the fluid and convert it to vapor.

9 Claims, 11 Drawing Figures

VAPOR GENERATING SYSTEM HAVING A DIVISION WALL PENETRATING A FURNACE BOUNDARY WALL FORMED IN PART BY ANGULARLY EXTENDING FLUID FLOW TUBES

BACKGROUND OF THE INVENTION

This invention relates to a vapor generator and, more particularly, to a sub-critical or super-critical once-through vapor generator system for converting water to vapor.

In general, a once-through vapor generator operates to circulate a pressurized fluid, usually water, through a vapor generating section and a superheating section to convert the water to vapor. In these arrangements, the water entering the unit makes a single pass through the circuitry and discharges through the superheating section outlet of the unit as superheated vapor for use in driving a turbine, or the like.

These arrangements provide several improvements over conventional drum-type boilers, and, although some problems arose in connection with early versions of the once-through generators, such as excessive thermal loses, mismatching of steam temperature, the requirement for sophisticated controls and additional valving during startup, these problems have been virtually eliminated in later generation systems.

In these later arrangements, the walls of the furnace section of the generator are formed by a plurality of vertically extending tubes having fins extending outwardly from diametrically opposed portions thereof, with the fins of adjacent tubes being connected together to form a gastight structure. During startup, super-critical water is passed through the furnace boundary walls in multiple passes to gradually increase its temperature. This requires the use of headers between the multiple passes to mix out heat unbalances caused by portions of the vertically extending tubes being closer to the burners than others or by the tubes receiving uneven adsorption because of local slag coverage, burners being out of service, and other causes. The use of these intermediate headers, in addition to being expensive, makes it undesirable to operate the furnace at variable pressure because of probability of separation of the vapor and liquid phases within the header and uneven distribution to the down-stream circuit. Therefore, this type of arrangement requires a pressure reducing station interposed between the furnace outlet and the separators to reduce the pressure to predetermined values and, in addition, requires a relatively large number of downcomers to connect the various passes formed by the furnace boundary wall circuitry.

In U.S. Pat. No. 4,116,168, issued on Sept. 26, 1978 and assigned to the same assignee as the present invention, a vapor generator is disclosed which incorporates the features of the system discussed above and yet eliminates the need for intermediate headers, additional downcomers, and a pressure reducing station. These improvements are achieved at least in part by forming the boundary walls of the furnace section of the vapor generator by a plurality of interconnected tubes a portion of which extend at an acute angle with respect to a horizontal plane. According to a preferred embodiment of this arrangement, the boundary walls defining the upper and lower portions of the furnace section of the vapor generator extend vertically while the tubes in the intermediate furnace portion extend at an acute angle with respect to a horizontal plane. The latter tubes are in fluid flow registry with the tubes in the lower and upper furnace portions, and wrap around the furnace section for at least one revolution.

This use of angularly extending tubes in the intermediate furnace section enables the fluid to average out furnace heat imbalances and be passed through the boundary walls in one complete pass thus eliminating the use of multiple passes and their associated mix headers and downcomers. As a result, the furnace can be operated at variable pressure and the need for a pressure reducing station is eliminated. Also as a result of the angularly extending tubes, a relatively high mass flow rate together with a large tube size is possible when compared to a vertical tube arrangement.

However, although the use of the angularly extending tubes has apparent advantages, there is a problem associated with their use. In particular, in the above-described generation of vapor generators a plurality of division walls are usually provided which are also formed by a plurality of interconnected tubes and which penetrate through one of the boundary walls as they extend from an area outside of the furnace section to an area within the furnace section. In this manner, the fluid may be passed through the division walls and heated an additional increment after passage through the boundary wall tubes and before being passed to the heat recovery area. However, the penetration of the angularly extending tubes of the boundary wall by the division walls creates problems such as those associated with sealing, tube drainability, heat transfer, etc., that are unique in these type of designs.

SUMMARY OF THE INVENTION

It is therefore, an object of the present invention to provide a vapor generator which incorporates the features of the arrangements discussed above and yet eliminates the need for intermediate headers, additional downcomers, and a pressure reducing station.

It is a further object of the present invention to provide a vapor generator of the above type in which the boundary walls of the furnace section of the vapor generator are formed by a plurality of interconnected tubes, a portion of which extend at an acute angle with respect to a horizontal plane.

It is a further object of the present invention to provide a vapor generator of the above type in which a plurality of divisional walls are provided which extend from an area external of the enclosure defined by the furnace boundary walls and which penetrate one of the latter walls.

It is a still further object of the present invention to provide a vapor generator of the above type in which the division walls penetrate the furnace boundary wall through a minimal area and in which the division wall has a vertical portion which extends for an optimum length within the enclosure defined by the furnace boundary walls.

It is a still further object of the present invention to provide a vapor generator of the above type in which the tubes forming the furnace boundary walls and the tubes forming the division walls are arranged and constructed in a manner to permit an optimum seal at the area of penetration to maintain furnace gas-tightness.

It is a still further object of the present invention to provide a vapor generator of the above type in which the tubes forming the furnace boundary walls and the tubes forming the division walls are arranged and constructed in a manner to enable the boundary wall tubes to be drainable at the area of penetration.

Toward the fulfillment of these and other objects, the vapor generator of the present invention comprises a plurality of tubes connected together and arranged to form the boundary walls of a gas-tight enclosure, the tubes extending at an acute angle with respect to a horizontal plane for at least a portion of the height of the enclosure. A plurality of division walls are associated with the enclosure, with each division wall comprising a plurality of interconnected tubes that penetrate the angularly extending tubes of a boundary wall as they extend from an area outside the enclosure to an area inside the enclosure. Seal means cooperate with the one boundary wall and the division wall portion for sealing the area of penetration to maintain the gas-tightness, and means are provided for passing fluid through the tubes to apply heat to the fluid.

BRIEF DESCRIPTION OF THE DRAWINGS

The above brief description, as well as further objects, features, and advantages, of the present invention will be more fully appreciated by reference to the following detailed description of a presently preferred but nonetheless illustrative embodiment in accordance with the present invention, when taken in connection with the accompanying drawings wherein.

DESCRIPTION OF THE PREFERRED EMBODIMENTS

Figure 1:
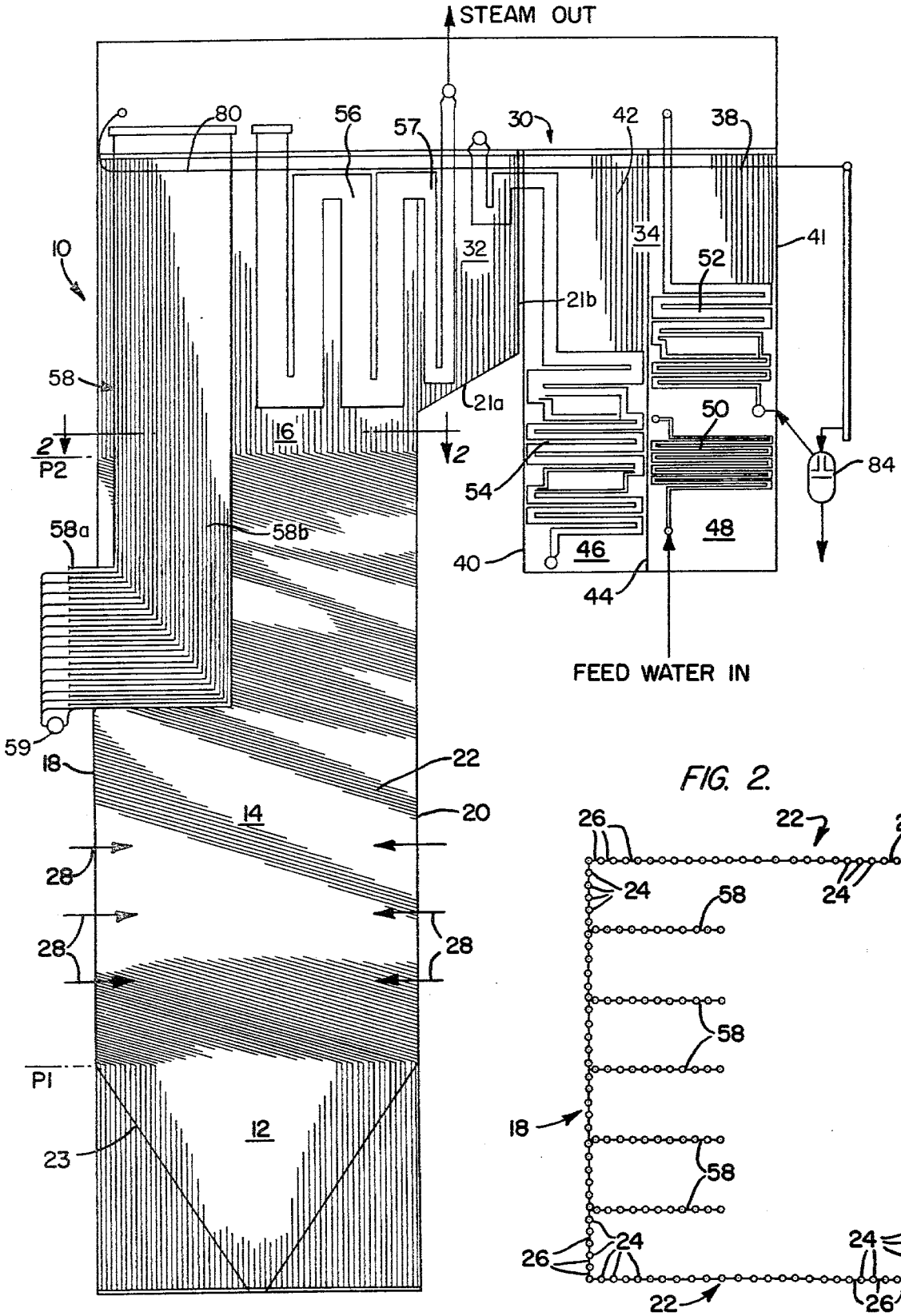
FIG. 1 is a schematic-sectional view of the vapor generator of the present invention.

Referring specifically to FIG. 1 of the drawings, the reference numeral 10 refers in general to the vapor generator of the present invention and includes a lower furnace section 12, an intermediate furnace section 14, and an upper furnace section 16. The boundary walls defining the furnace sections 12, 14, and 16 include a front wall 18, a rear wall 20 and two sidewalls extending between the front and rear walls, with one of said sidewalls being referred to by the reference numeral 22. The lower portions of the front wall 18 and the rear wall 20 are sloped inwardly to form a hopper section 23 at the lower furnace section 12 for the accumulation of ash, and the like, in a conventional manner.

Figure 2:
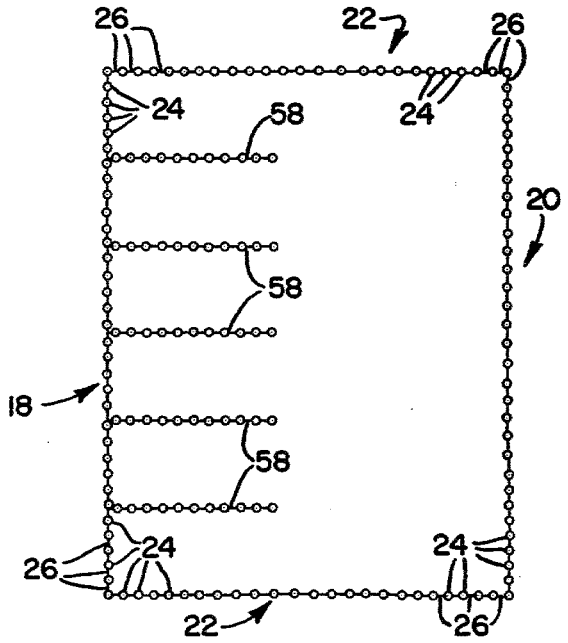
FIG. 2 is a sectional view taken along the line 2—2 of FIG. 1.

As better shown in FIG. 2, each of the walls 18, 20, and 22 are formed of a plurality of tubes 24 having continuous fins 26 extending outwardly from diametrically opposed portions thereof, with the fins of adjacent tubes being connected together in any known manner, such as by welding, to form a gas-tight structure.

Figure 3:
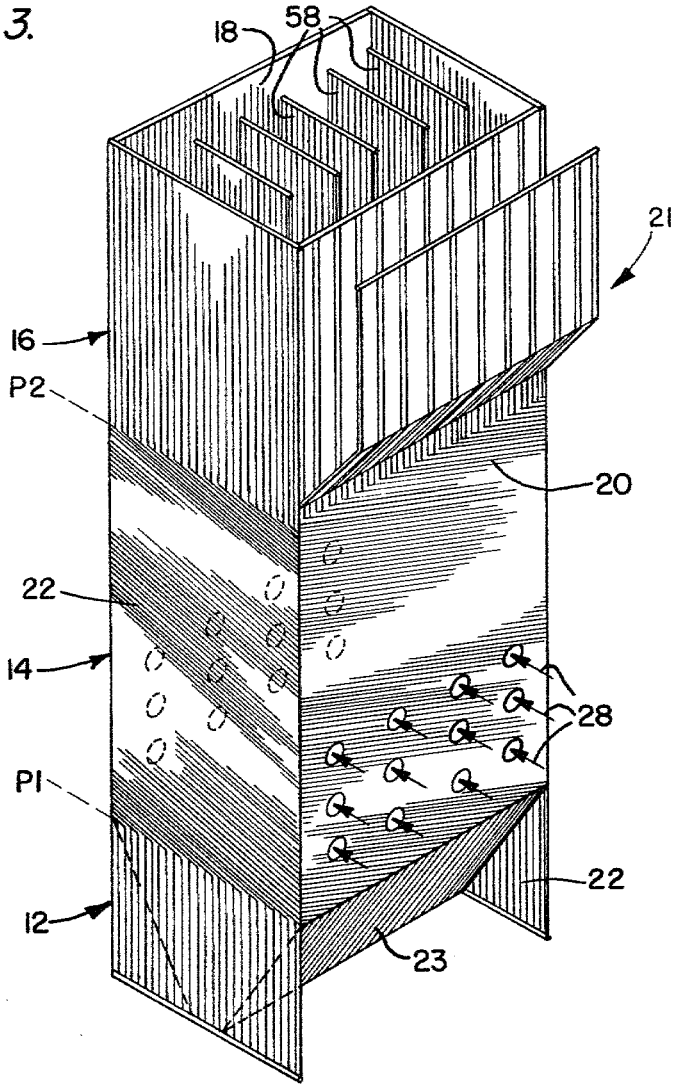
FIG. 3 is a partial, perspective view of a portion of the vapor generator of FIG. 1.

Referring specifically to FIGS. 1 and 3, in the lower furnace section 12 the tubes 24 in the sidewalls 22 extend vertically up to a horizontal plane P1 located at the upper portion of the hopper section 23, while the tubes 24 in the front wall 18 and the rear wall 20 are sloped inwardly from the latter plane to form the hopper section 23. The tubes 24 forming the walls 18, 20, and 22 in the intermediate section 14 extend from the plane P1 to a plane P2 disposed in the upper portion of the vapor generator 10, with these tubes extending at an acute angle with respect to the planes P1 and P2. The tubes 24 forming the walls 18, 20, and 22 of the upper furnace section 16 extend vertically from the plane P2 to the top of the latter section with the exception of a portion of the tubes in the rear wall 20 which are bent out of the plane of the latter wall to form a branch wall 21 as will be explained in detail later.

The tubes 24 in the intermediate section 14 extend from plane P1 and wrap around for the complete perimeter of the furnace at least one time to form the corresponding portions of the walls 18, 20, and 22 before they terminate at the plane P2. The tubes 24 in the intermediate section 14 have a plurality of fins 26 which are arranged and which function in an identical manner to the fins of the tubes in the lower furnace section 12 and in the uppr furnace section 14.

Although not clear from the drawings, it is understood that each tube 24 in the intermediate furnace section 14 is connected to, and registers with, two tubes 24 in the upper furnace section 16 and with two tubes 24 in the lower furnace section 12, with the connections being made by bifurcates extending between the respective tubes as disclosed in detail in U.S. Pat. No. 4,178,881, issued Dec. 18, 1977, and assigned to the same assignee as the present invention.

As mentioned above, the upper portion of the rear wall 20 in the upper furnace section 16 has a branch wall 21, shown in general in FIG. 3, formed by bending a selected number of tubes 24 from the rear wall 20 outwardly to form an angular portion **21*a* (FIG. 1) and then upwardly to form a vertical portion 21*b*. As a result, spaces are defined between the remaining tubes 24 in the upper portion of the wall 20 as well as between the portions of the tubes forming the vertical portion 21*b* of the branch wall 21. This permits combustion gases to exit from the upper furnace section 16**, as will be described later.

A plurality of burners 28 are disposed in the front and rear walls 18 and 20 in the intermediate furnace section 14, with the burners being arranged in this example in three vertical rows of four burners per row. The burners 28 are shown schematically since they can be of a conventional design.

Referring again to FIG. 1, a heat recovery area, shown in general by the reference numeral 30, is provided adjacent the upper furnace section 16 in gas flow communication therewith, and includes a vestibule section 32 and convection section 34. The floor of the vestibule section 32 is formed by the angular portion **21*a* of the branch wall 21 with the tubes 24 in this portion being provided with fins which are connected to fins of adjacent tubes to render the floor gas-tight. The remaining portions of the tubes 24 forming the vertical portion 21*b* of the branch wall 21 extend in a spaced relation to permit gases to pass from the vestibule section 32 to the convection section 34**.

The convection section 34 includes a front wall 40 the upper portion of which is formed by a plurality of tubes extending in a spaced relationship to permit the gases from the vestibule section to enter the convection section. The heat recovery area 30 also includes a rear wall 41 and two sidewalls 42, with one of the latter being shown in FIG. 1. It is understood that the rear wall 41, the sidewalls 42, and the lower portion of the front wall 40 are formed of a plurality of vertically extending, finned, interconnected tubes 24 in a manner similar to that of the upper furnace section 16.

A partition wall 44, also formed by a plurality of finned, interconnected tubes 24, is provided in the heat recovery area 30 to divide the latter into a front gas pass 46 and a rear gas pass 48. An economizer 50 is disposed in the lower portion of the rear gas pass 48, a primary superheater 52 is disposed immediately above the economizer, and a bank of reheater tubes 54 is provided in the front gas pass 46.

A platen superheater 56 is provided in the upper furnace section 16 and a finishing superheater 57 is provided in the vestibule section 32 in direct fluid communication with the platen superheater 56.

The upper end portions of the walls 18, 20, and 22, and the branch wall 21, as well as the partition wall 44, the sidewalls 42 and the rear wall 41 of the heat recovery area 30 all terminate in substantially the same general area in the upper portion of the vapor generating section 10.

As better shown in FIGS. 1 and 2, a plurality of division walls 58 are provided with each having a horizontal portion **58*a* and a vertical portion 58*b*. Each division wall 58 is formed by a plurality of finned interconnected tubes 24 as shown in FIG. 2. Referring again to FIGS. 1 and 3, the horizontal portions 58*a* of each division wall 58 extend from a header 59 located externally and adjacent to the front wall 18 and penetrate the latter wall before they are bent upwardly to form the vertical portions 58*b*. The upper end of each vertical division wall portion terminates in substantially the same general area as the walls 18, 20, and 22**.

Figure 4:
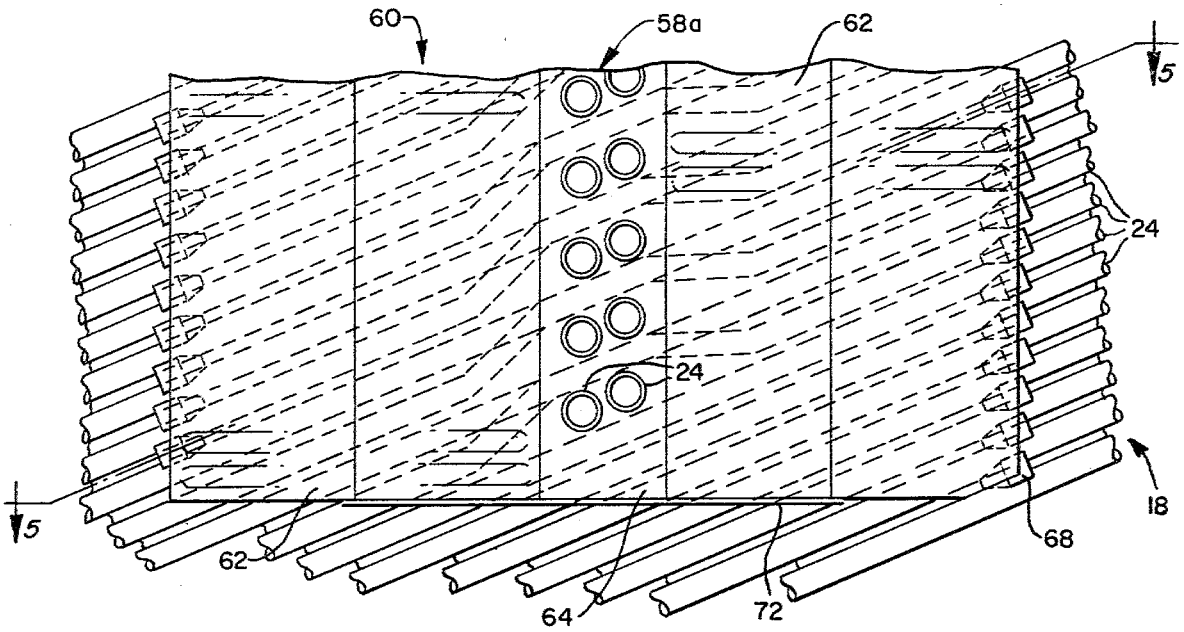
FIG. 4 is an enlarged, partial, front elevational view of a portion of a boundary wall of the vapor generator of FIG. 1.
Figure 5:
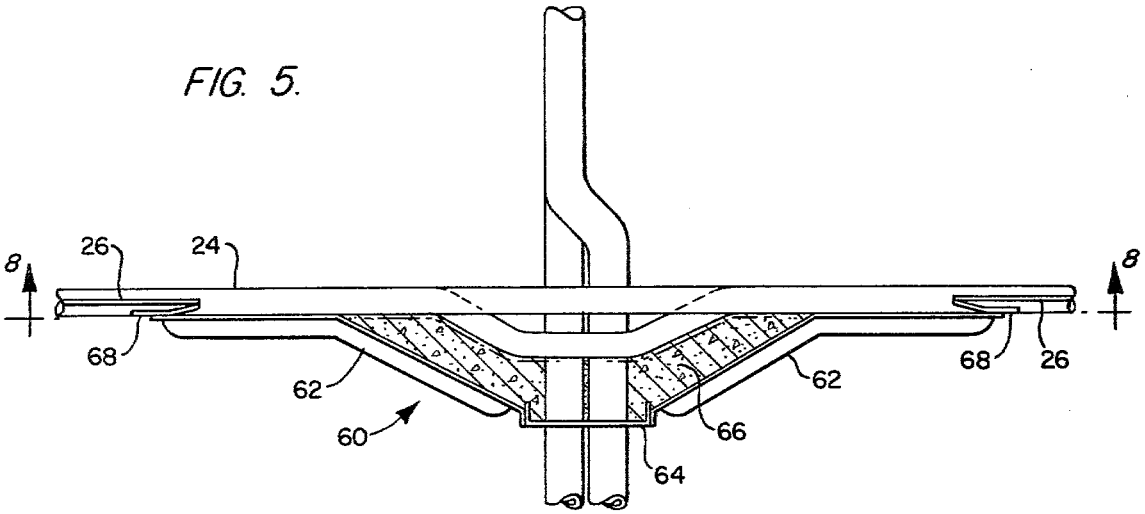
FIG. 5 is a cross-sectional view taken along the line 5—5 of FIG. 4.
Figure 6:
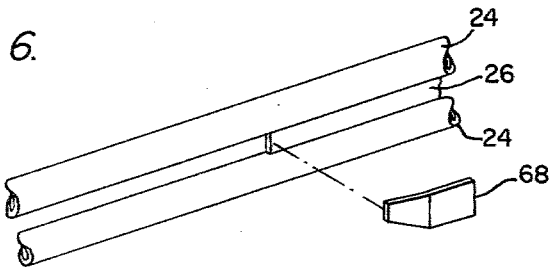
FIG. 6 is a partial, exploded perspective view of a portion of the components shown in FIG. 5.

A sealing assembly shown in general by the reference numeral 60, is provided for the area of penetration of the front wall 18 by each horizontal division wall portion **58*a* and is shown in connection with one of the latter wall portions in FIGS. 4–6. More specifically, the sealing assembly 60 includes a pair of seal plates 62 extending along an area of the front wall 18 adjacent the area of penetration and having a plurality of horizontal corrugations to accommodate thermal expansion of the plates in a vertical direction. It is noted from FIG. 5 that one portion of each of the seal plates 62 extends along the plane of the wall 18 while a second portion thereof extends at an angle to the latter plane to form a space which receives a refractory material shown in general by the reference numeral 66. A channel member 64 extends between the seal plates 62 and has a plurality of openings corresponding to the diameters of the tubes 24 forming the divisional wall portion 58*a* The flange portions of the channel member 64 is connected to the corresponding ends of the seal plates 62** in any known manner, such as by welding.

Figure 7:
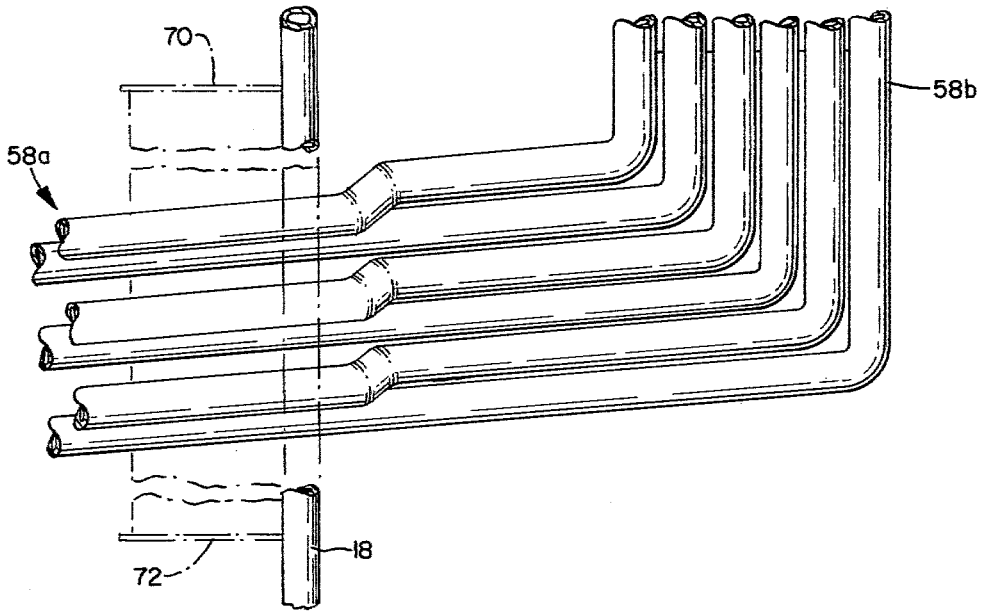
FIG. 7 is an enlarged, partial, side elevational view of a portion of the vapor generator of FIG. 1.

As shown in FIGS. 5 and 6, the tubes 24 forming the front wall 18 are not provided with fins 26 inside the area covered by the seal plates 62 and a spacer plate 68 is provided to connect the inner surface of the corresponding portions of the seal plates 62 to the end portions of the fins 26. As shown in FIG. 7, the seal plate assembly is completed by upper and lower cover plates 70 and 72, respectively, which, together with the other components of the seal assembly, maintain the gas-tightness through the area of penetration of the front wall 18 by the divisional wall portion **58*a***.

As noted in FIG. 4, each division wall portion **58*a* is formed of two vertically extending rows of tubes 24 with the tubes of one row being displaced from the tubes of the other row by an angle corresponding to the angle that the tubes 24 forming the wall 18 in the intermediate section thereof extend with respect to the planes P1 and P2**.

Figure 8:
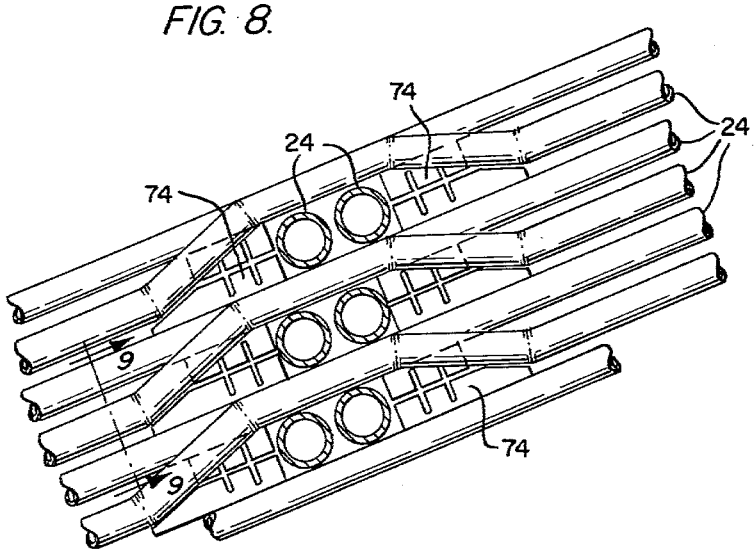
FIGS. 8 and 9 are cross-sectional views taken along the line 8—8 of FIG. 5 and the line 9—9 of FIG. 8, respectively.
Figure 9:
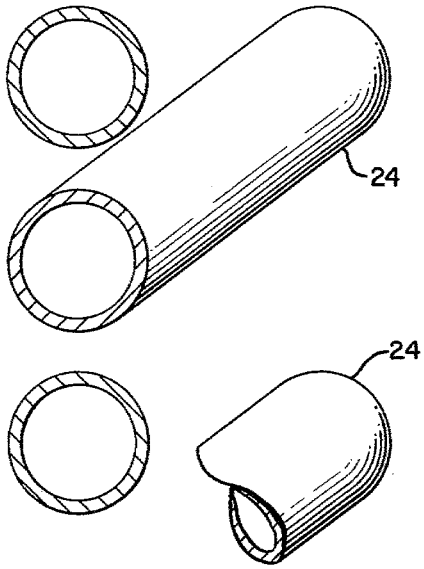
Figure 10:
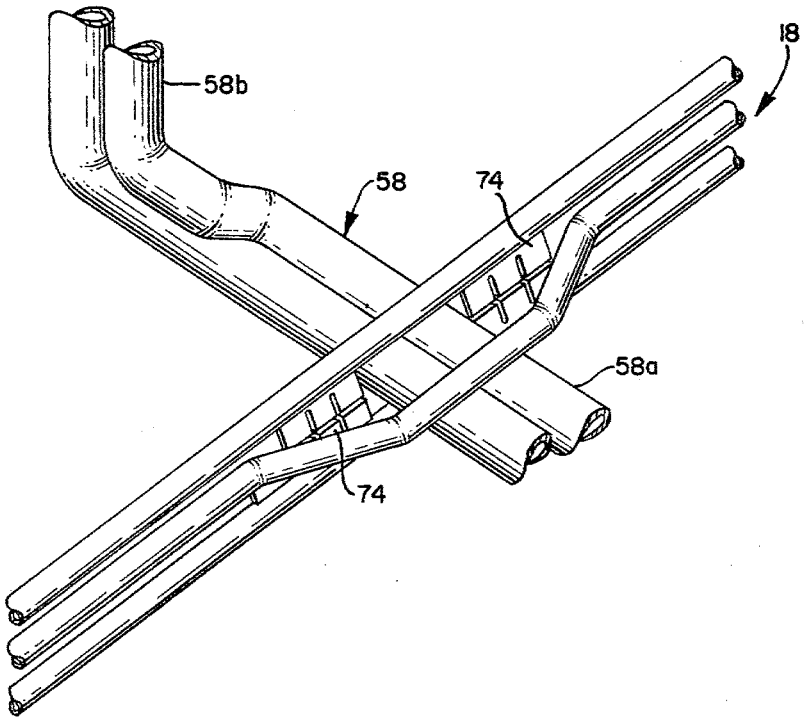
FIG. 10 is a partial, enlarged, perspective view of a portion of the vapor generator of FIG. 1.

As shown in FIGS. 8, 9, and 10, the bent tube portions of the tubes 24 of the front wall 18 are bent in a first plane outwardly from the plane of the drawing and then in a second plane upwardly as viewed in FIG. 8 to provide the clearance for the two rows of tubes 24 of the division wall portion **58*a*. As a result of the foregoing bending, the tubes 24** of the front wall portion have several bent portions extending at an angle to each other and to the remaining portions of the tubes, which bent portions all are slanted with respect to the horizontal in order to permit drainability of the tubes during shutdown.

As shown in FIG. 8, a slotted fin 74 is provided in the exposed areas adjacent the penetrating tubes 24 to aid in maintaining gas-tightness, to protect the sealing assembly from the hot gases in the furnace, and to allow for thermal expansion between the various tubes.

As shown in FIGS. 7 and 10, each tube of one row of the tubes forming the divisional wall portion **58*a* is bent laterally inside the front wall 18 to align in a coplanar relationship with the remaining tubes of the division wall portion and then all of the tubes of the latter division wall portion are bent at a right angle upwardly to form the division wall portion 58*b***.

A roof 80 is disposed in the upper portion of the section 10 and consists of a plurality of tubes 24 having fins 26 connected in the manner described above but extending horizontally from the front wall 18 of the furnace section to the rear wall 41 of the heat recovery area 30.

It can be appreciated from the foregoing that combustion gases from the burners 28 in the intermediate furnace section 14 pass upwardly to the upper furnace section 16 and through the heat recovery area 30 before exiting from the front gas pass 46 and the rear gas pass 48. As a result, the hot gases pass over the platen superheater 56, the finishing superheater 57 and the primary superheater 52, as well as the reheater tubes 54 and the economizer 50, to add heat to the fluid flowing through these circuits.

Although not shown in the drawings for clarity of presentation, it is understood that suitable inlet and outlet headers, downcomers and conduits, are provided to place the tubes 24 of each of the aforementioned walls and heat exchangers as well as the roof 80 in fluid communication to establish a flow circuit that will be described in detail later.

Figure 11:
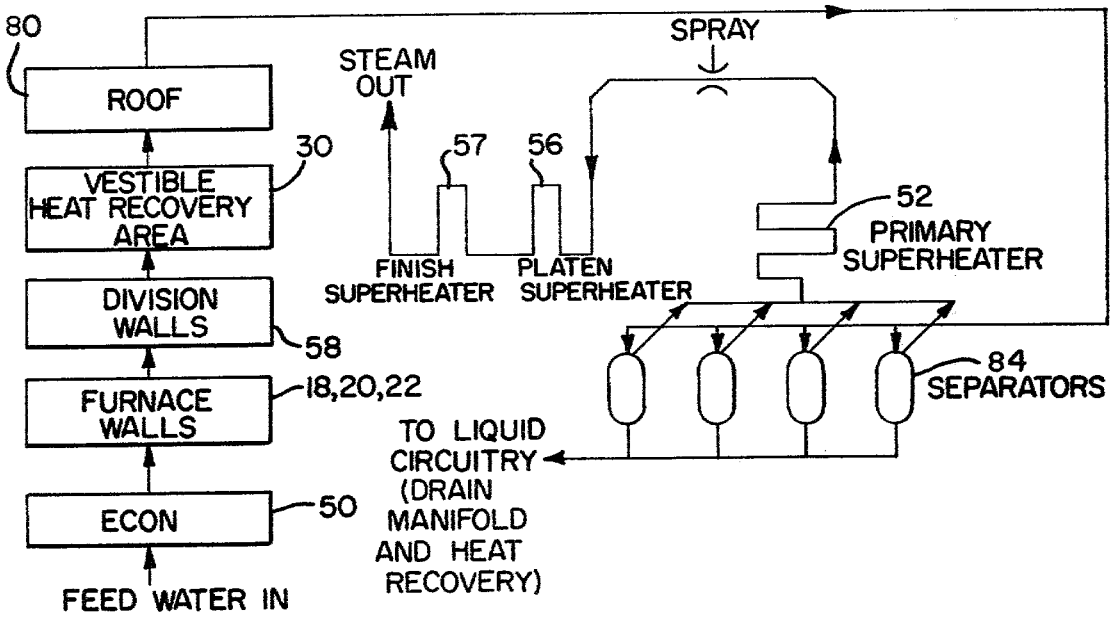
FIG. 11 is a schematic diagram depicting the flow circuit of the vapor generator of the present invention.

As shown in FIGS. 1 and 11, a plurality of separators 84 are disposed in a parallel relationship adjacent the rear wall 41 of the heat recovery area 30 in the main flow circuit between the roof 80 and the primary superheater 52. The separators 84 operate in a known manner to separate the fluid from the roof 80 into a liquid and vapor. The vapor from the separators 84 is passed directly to the primary superheater 52 and the liquid is passed to a drain manifold and heat recovery circuitry for further treatment as also disclosed in the above-mentioned application.

The fluid circuit including the various components, passes and sections of the vapor generator 10 of FIG. 1 is also shown in FIG. 11. In particular, feedwater from an external source is passed through the economizer tubes 50 to raise the temperature of the water before it is passed to inlet headers (not shown) provided at the lower portions of the furnace walls 18, 20, and 22. All of the water flows upwardly and simultaneously through the walls 18, 20, 21, and 22 to raise the temperature of the water further to convert at least a portion of same to vapor, before it is collected in suitable headers located at the upper portion of the vapor generator 10. The fluid is then passed downwardly through a suitable downcomer, or the like, and then upwardly through the division walls 58 to add additional heat to the fluid. The fluid is then directed through the walls 40, 41, 42, and 44 of the heat recovery area 30 after which it is collected and passed through the roof 80. From the roof 80, the fluid is passed via a suitable collection headers, or the like, to the separators 84 which separate the vapor portion of the fluid from the liquid portion thereof. The liquid portion is passed from the separators to a drain manifold and heat recovery circuitry (not shown) for further treatment and the vapor portion of the fluid in the separators 64 is passed directly into the primary superheater 52. From the latter, the fluid is spray attemperated after which it is passed to the platen superheater 56 and the finishing superheater 57 before it is passed in a dry vapor state to a turbine, or the like.

Several advantages result from the foregoing. For example, the use of the angularly extending tubes 24 which wrap around to form the intermediate furnace section 14 enables the fluid to average out furnace heat unbalances and be passed through the boundary walls 18, 20, and 22 of the furnace section in one complete pass, thus eliminating the use of multiple passes and their associated mix headers and downcomers. Also, as a result of the angularly extending tubes 24, the furnace section can operate at a variable pressure without the need for a pressure reducing station and a relatively high mass flow rate and large tube size can be utilized over that possible with vertical tube arrangements.

Also, the seal assembly 60 maintains gas-tightness of the furnace while permitting penetration of the front wall 18 by the divisional wall portions 58*a*. Further, the provision of the division wall portion 58*a* into two rows minimizes vertical spacing and enables a relatively large portion of the division wall 58*b* to extend vertically within the enclosure defined by the walls 18, 20, and 22. Further, the portions of the front wall 18 that are bent in the area of penetration to accommodate the tubes of the division wall 18 in the area of penetration, are bent in such a manner to enable them to be drained when needed.

It is understood that while the preferred embodiment described above includes a furnace having a substantially rectangular shaped cross-sectional area, other cross-sectional configurations, such as those having a circular or elliptical patterns, may be utilized as long as the angular tube arrangement is maintained. For example, the furnace may have a helical configuration in a pattern conforming to the cross-sectional shape of the furnace. (In this context, it should be noted that the type of boiler covered by the present invention in which the tubes are angularly arranged in the furnace boundary wall is commonly referred to by those skilled in the art as a "helical tube boiler," notwithstanding the fact that a true mathematical helix is not generated in a boiler which has a substantially rectangular cross-sectional area.) It is also understood that the tubes may wrap around the furnace for more than one complete revolution, depending on the overall physical dimensions of the furnace.

It is further understood that portions of the vapor generator have been omitted for the convenience of presentation. For example, insulation and support systems can be provided that extend around the boundary walls of the vapor generator as discussed above and a windbox, or the like, may be provided around the burners 28 to supply the air to same in a conventional manner. It is also understood that the upper end portions of the tubes 24 forming the upper furnace section 16 and heat recovery area 30 can be hung from a location above the vapor generating section 10 to accommodate thermal expansion in a conventional manner.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. A vapor generator comprising a plurality of tubes connected together and arranged to form the boundary walls of a gas-tight enclosure, said tubes extending at an acute angle with respect to the horizontal for at least a portion of the height of said enclosure, at least one division wall associated with said enclosure, said division wall comprising a plurality of interconnected tubes and having a first portion extending within said enclosure and a second portion extending integrally with said first portion and penetrating one of said boundary walls, portions of the tubes forming said one boundary wall being bent outwardly from the plane of said boundary wall to form the area of penetration, said bent tube portions extending at an angle downwardly from the horizontal to enable said tube portions to be drained of said fluid, seal means cooperating with said one boundary wall and said division wall portion for sealing the area of penetration of said one boundary wall by said second division wall portion to maintain said gas-tightness, heating means associated with said enclosure, and means for passing fluid through said tubes to apply heat to said fluid.

2. The vapor generator of claim 1, wherein the tubes of said first division wall portion extend vertically.

3. The vapor generator of claim 1, wherein the tubes of said second division wall portion extend horizontally from an area externally of said enclosure to an area internally of said enclosure.

4. The vapor generator of claim 1, wherein said seal means comprises a corrugated plate extending over said area of penetration.

5. The vapor generator of claim 1, wherein said bent tube portions are further bent in another plane parallel to the plane of said one boundary wall.

6. The vapor generator of claim 1, wherein the tubes of said second division wall portion penetrate said one boundary wall in two rows disposed relative to one another at an angle corresponding to said acute angle.

7. The vapor generator of claim 6, wherein that portion of each alternate tube of said second division wall portion extending within said enclosure is bent in a manner to extend coplanar with the remaining tubes of said second division wall portion.

8. The vapor generator of claim 1, wherein said tubes forming said one boundary wall are connected together by fins extending from diametrically opposed surfaces of said tubes for the length of said tubes, and wherein said fins are slotted in said area of penetration to accommodate relative expansion between the tubes of said second division wall portion.

9. A vapor generator comprising a plurality of tubes connected together and arranged to form the boundary walls of a gas-tight enclosure, said tubes extending at an acute angle with respect to a horizontal plane for at least a portion of the height of said enclosure, at least one division wall associated with said enclosure, said division wall comprising a plurality of interconnected tubes and having a first portion extending within said enclosure and a second portion extending integrally with said first portion and penetrating one of said boundary walls, portions of the tubes forming said one boundary wall being bent outwardly from the plane of said boundary wall to form the area of penetration, seal means cooperating with said one boundary wall and said division wall portion for sealing the area of penetration of said one boundary wall by said second division wall portion to maintain said gas-tightness, said seal means comprising a corrugated plate extending over said area of penetration, a first portion of the corrugated plate extending along the plane of said one boundary wall, a second portion of the corrugated plate extending at an angle to the plane of said boundary wall to define a space, refractory material positioned in the space, heating means associated with said enclosure and means for passing fluid through said tubes to apply heat to said fluid.

* * * * *